US011608562B2

(12) United States Patent
Yang

(10) Patent No.: US 11,608,562 B2
(45) Date of Patent: Mar. 21, 2023

(54) METHOD FOR PRODUCTION OF METAL ARTICLE OF MANUFACTURE AND USES THEREOF

(71) Applicant: Kyung Mo Yang, Flushing, NY (US)

(72) Inventor: Kyung Mo Yang, Flushing, NY (US)

( * ) Notice: Subject to any disclaimer, the term of this patent is extended or adjusted under 35 U.S.C. 154(b) by 267 days.

(21) Appl. No.: 17/009,277

(22) Filed: Sep. 1, 2020

(65) Prior Publication Data

US 2020/0392634 A1 Dec. 17, 2020

Related U.S. Application Data

(62) Division of application No. 16/012,215, filed on Jun. 19, 2018, now Pat. No. 10,793,959.
(Continued)

(51) Int. Cl.

| | |
|---|---|
| ***C25C 5/02*** | (2006.01) |
| ***C25C 1/20*** | (2006.01) |
| ***B22F 3/14*** | (2006.01) |
| ***B22F 1/00*** | (2022.01) |
| ***C25C 7/02*** | (2006.01) |

(Continued)

(52) U.S. Cl.
CPC ..... *C25C 5/02* (2013.01); *B22F 1/0007* (2013.01); *B22F 1/0547* (2022.01); *B22F 3/1143* (2013.01); *B22F 3/14* (2013.01); *B22F 3/16* (2013.01); *C25C 1/20* (2013.01); *C25C 7/02* (2013.01); *B22F 2301/255* (2013.01); *B22F 2998/10* (2013.01)

(58) Field of Classification Search
CPC ..... C25C 1/20; C25C 5/02; C25C 7/02
See application file for complete search history.

(56) References Cited

U.S. PATENT DOCUMENTS 3,994,785 A * 11/1976 Rippere ..... C25C 7/002 205/291
4,874,436 A 10/1989 Ogata et al.
(Continued)

FOREIGN PATENT DOCUMENTS

CN 1192165 A 9/1998
CN 101608271 A 12/2009
(Continued)

OTHER PUBLICATIONS

Production of ultrahigh purity copper using waste copper nitrate solution (Year: 2003).*
(Continued)

*Primary Examiner* — Jenny R Wu
(74) *Attorney, Agent, or Firm* — Lucas & Mercanti, LLP

(57) ABSTRACT

A method for making a porous metal article of manufacture is provided. The method includes subjecting a saturated aqueous electrolytic solution wherein silver or copper is a donor in a container with two electrodes, where dendrite crystals of silver or copper or silver or copper nanowires are formed and collected. The collected dendrite crystals or nanowires are pressed and sintered, thereafter cooled to room temperature at room temperature and finally pressing the cooled geometric shape to form the porous silver metal article of manufacture. The collected dendrites crystals or nanowires also can be pressed in a carbon based mold or, alternatively, a non-carbon based mold and in vacuum, sintered, cooled to room temperature.

12 Claims, 11 Drawing Sheets

Related U.S. Application Data

(60) Provisional application No. 62/521,829, filed on Jun. 19, 2017.

(51) Int. Cl.

| | |
|---|---|
| ***B22F 3/16*** | (2006.01) |
| ***B22F 3/11*** | (2006.01) |
| ***B22F 1/054*** | (2022.01) |

(56) References Cited

U.S. PATENT DOCUMENTS

| | | | | |
|---|---|---|---|---|
| 4,944,797 | A | | 7/1990 | Kemp, Jr. et al. |
| 5,451,273 | A | | 9/1995 | Howard et al. |
| 5,820,653 | A | * | 10/1998 | Eamon ..... C22C 1/0425 75/718 |
| 9,812,700 | B2 | | 11/2017 | Okamoto |
| 2013/0051176 | A1 | | 2/2013 | Tustin et al. |

FOREIGN PATENT DOCUMENTS

| | | | | |
|---|---|---|---|---|
| CN | 102618745 | A | | 8/2012 |
| CN | 103046088 | A | * | 4/2013 |
| CN | 103046088 | A | | 4/2013 |
| CN | 103215470 | A | | 7/2013 |
| CN | 103526064 | A | | 1/2014 |
| CN | 104818503 | A | * | 8/2015 |
| CN | 105780048 | A | | 7/2016 |
| CN | 106435665 | A | | 2/2017 |
| CN | 106994512 | A | | 8/2017 |
| EP | 3174375 | A1 | | 5/2017 |
| JP | 2005307270 | A | | 11/2005 |
| JP | 4723579 | B2 | | 4/2011 |
| JP | 6122016 | B2 | | 4/2017 |

OTHER PUBLICATIONS

Pulsed electrodeposition of copper (Year: 1992).*

A.H. Abbar; Electrolytic preparation of copper powder with particle size less than 63 μm; Al-Qadisiya Journal For Engineering Sciences; vol. 1; No. 1; 2008; pp. 32-45.

C. Wenzi; Anode casting—Physical anode quality; Proceedings of EMC 2007; 17 pages.

Q. Zhou et al., "Synthesis of highly crystalline silver dendrites microscale nanostructures by electrodeposition", Material Letters, 2006, vol. 60, pp. 3789-3792.

* cited by examiner

METHOD FOR PRODUCTION OF METAL ARTICLE OF MANUFACTURE AND USES THEREOF

CROSS REFERENCE TO RELATED APPLICATION

This Application is a divisional of U.S. patent application Ser. No. 16/012,215 filed Jun. 19, 2018 which in turn claims priority from U.S. Provisional Application No. 62/521,829 filed on Jun. 19, 2017, each of which are incorporated herein by reference.

FIELD OF THE INVENTION

The present invention relates to a method for the production of silver metal article of manufacture including porous material. The present invention also relates to a method for the production of a porous copper metal article of manufacture.

BACKGROUND OF THE INVENTION

Porous materials or filters have been developed for use in a wide variety of applications such as filtering liquids, purifying gas streams and for other separation processes. Different types of porous materials are described in the prior art. The materials can have a variety of shapes and have been fabricated from different materials. There exists much evidence giving support to the concept of using silver for its bactericidal effects and a wide variety of sterilization and decontamination techniques for producing potable water. However, most are either difficult and/or costly to implement. Thus, use of silver porous material is of interest, primarily due to its portability.

Furthermore, it is known in the art to extract silver from silver containing solutions such as silver nitrate solutions. However, the method consists of using copper and inserting into an aqueous solution of silver nitrate to allow silver crystals to grow. Thus, copper displaces silver ions from the solution and the electrochemical process is an electrolysis in which copper serves as an anode and deposited silver as the cathode. In the present invention both the anode and cathode are silver.

It is therefore, a general object of this invention to provide an improved and economical process for making the silver metal porous material. Additionally, is another object of the invention to provide an improved and economical process for making a porous copper metal article of manufacture.

SUMMARY OF THE INVENTION

The present invention is directed to a process for making a silver metal article of manufacture which is made using an aqueous solution of a silver donor such as silver nitrate or silver sulfate, electrolysis of the solution using an anode and a cathode that are made of silver, forming and collecting silver dendritic crystals or silver nanowires, pressing them into a geometric shape, sintering, cooling and finally pressing the cooled geometric shape to form the silver metal article of manufacture.

The present invention is also directed to a process for making a porous copper metal article of manufacture which is made by forming a saturated aqueous solution of copper wherein copper is the donor, such as copper nitrate, electrolysis of the solution using an anode and a cathode that are made of copper, harvesting dendritic crystals of copper or copper nanowires from the bottom of the solution, pressing and packing them into molds, such as carbon-based mold or in vacuum in order to minimize oxidation; heating the molded form, cooling and optionally treating with a silver plating solution to protect it from oxidation.

DETAILED DESCRIPTION OF THE INVENTION

Figure 1:
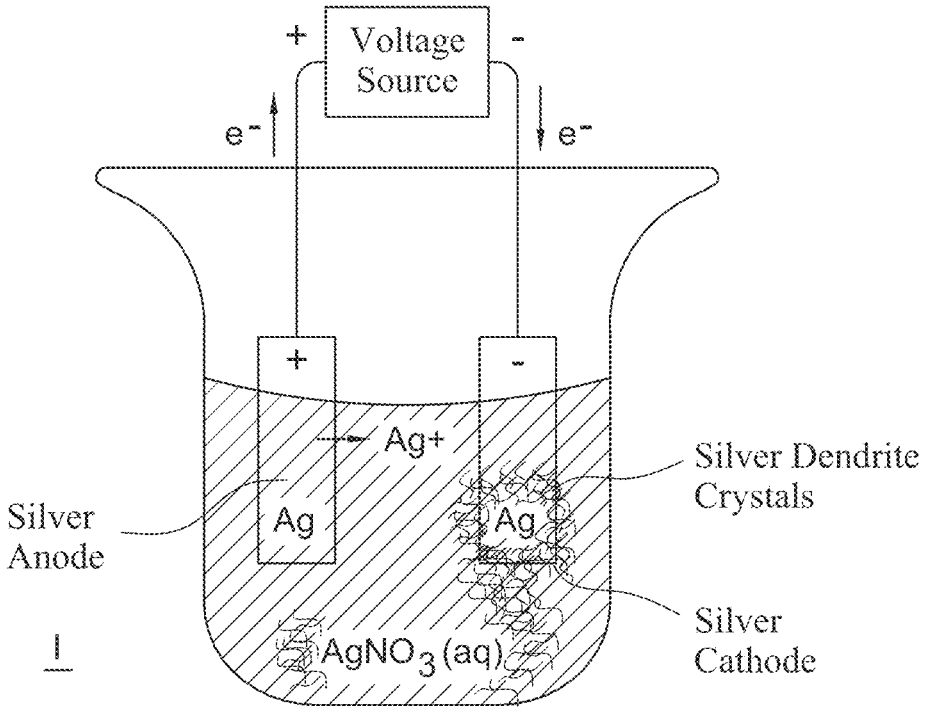
FIG. 1 shows the process according to the invention where dendrite crystals of silver are formed.
Figure 2:
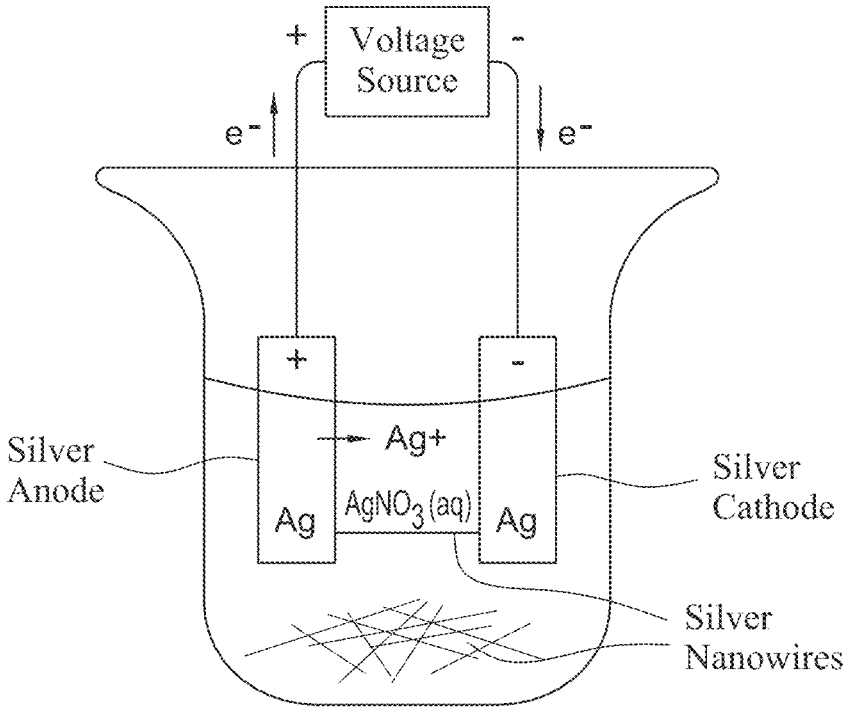
FIG. 2 shows the process according to the invention where silver nanowires are formed.
Figure 3:
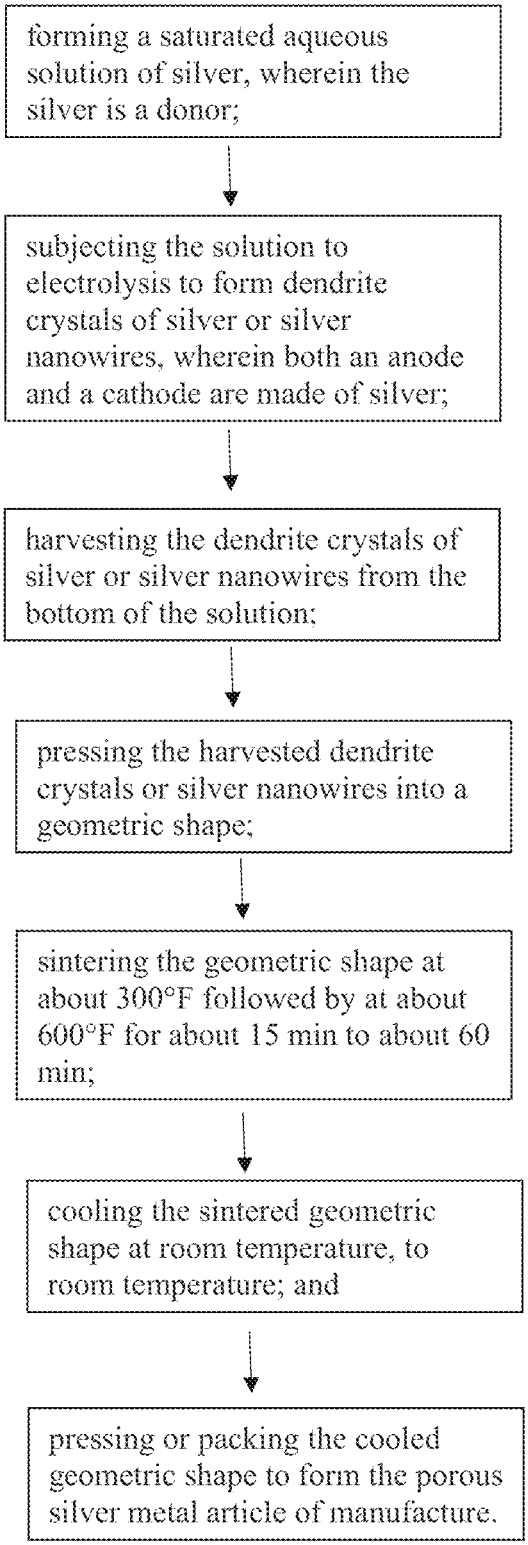
FIG. 3 is a flow chart of the process according to the invention.
Figure 4:
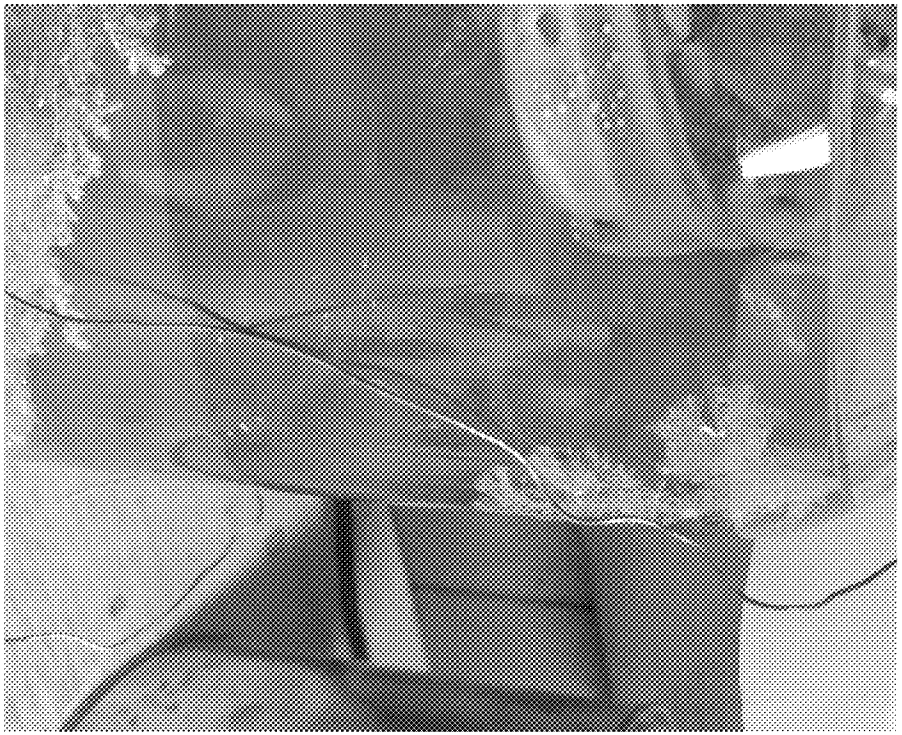
FIG. 4 shows a view of the formation of silver dendrites.
Figure 5:
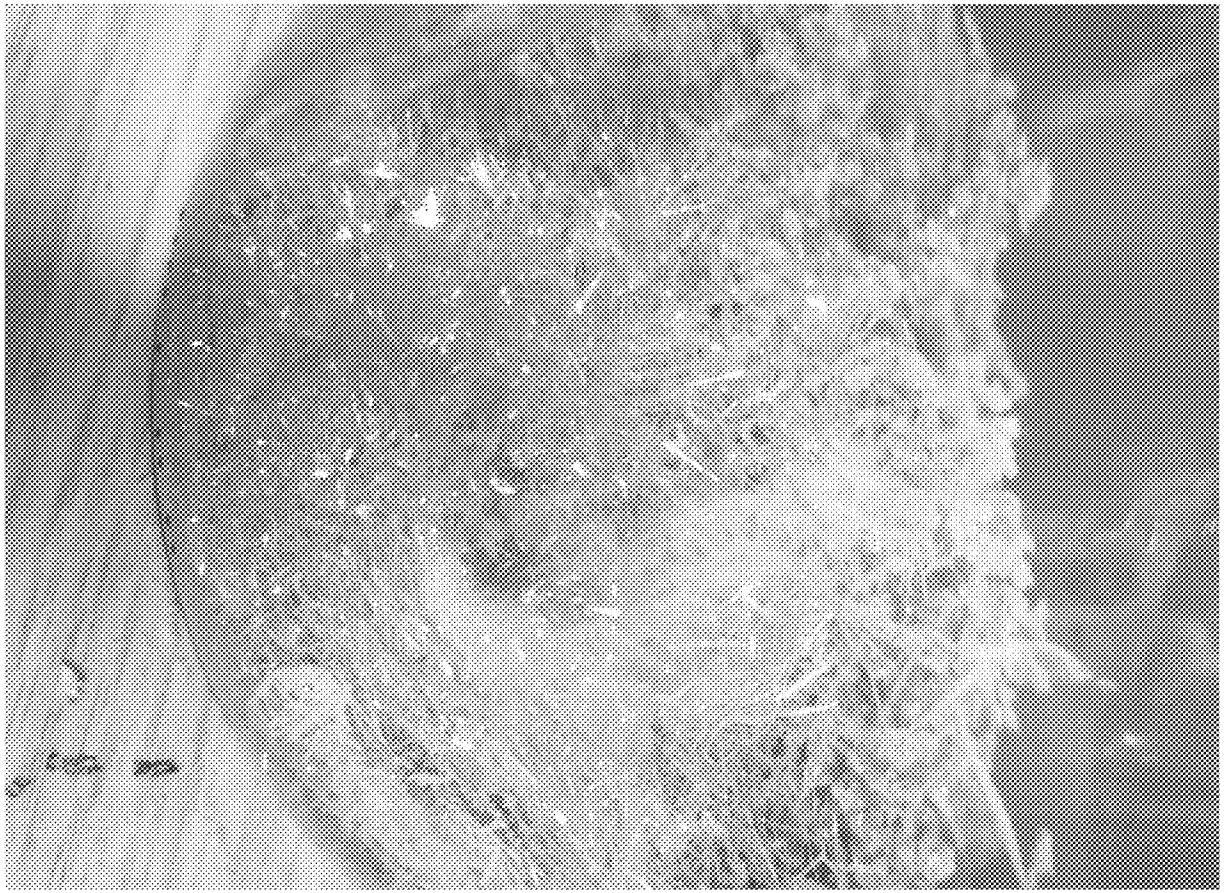
FIG. 5 shows a close-up view of the formed silver dendrites.
Figure 6:
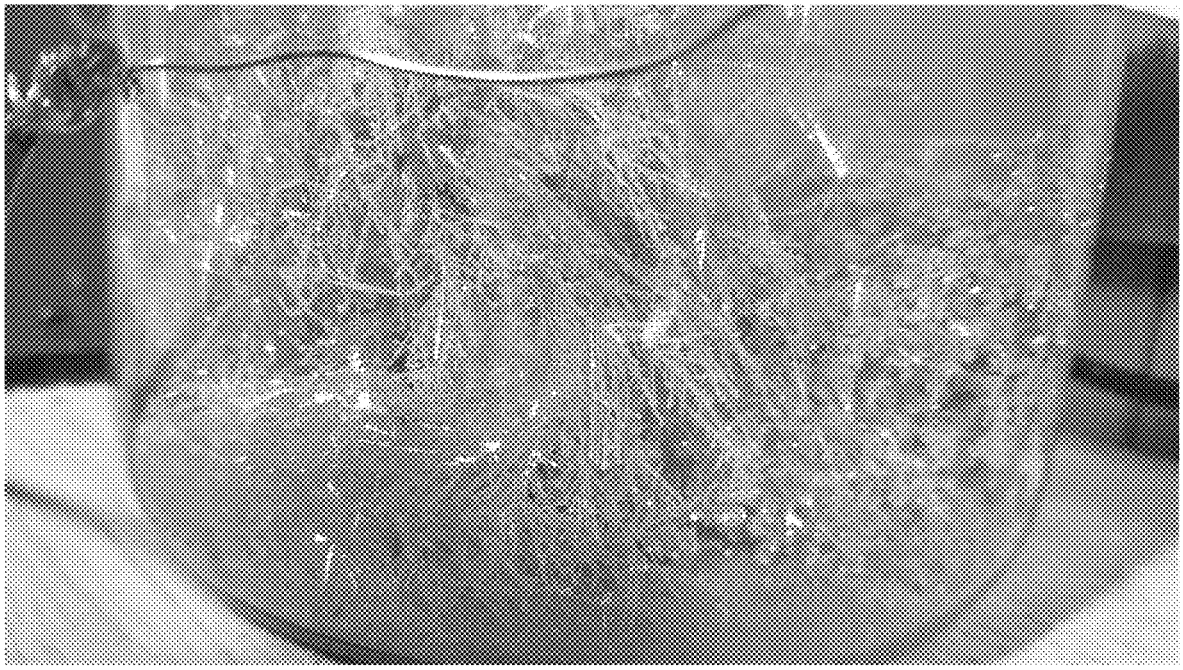
FIG. 6 shows another close-up view of the formed silver dendrites.
Figure 7:
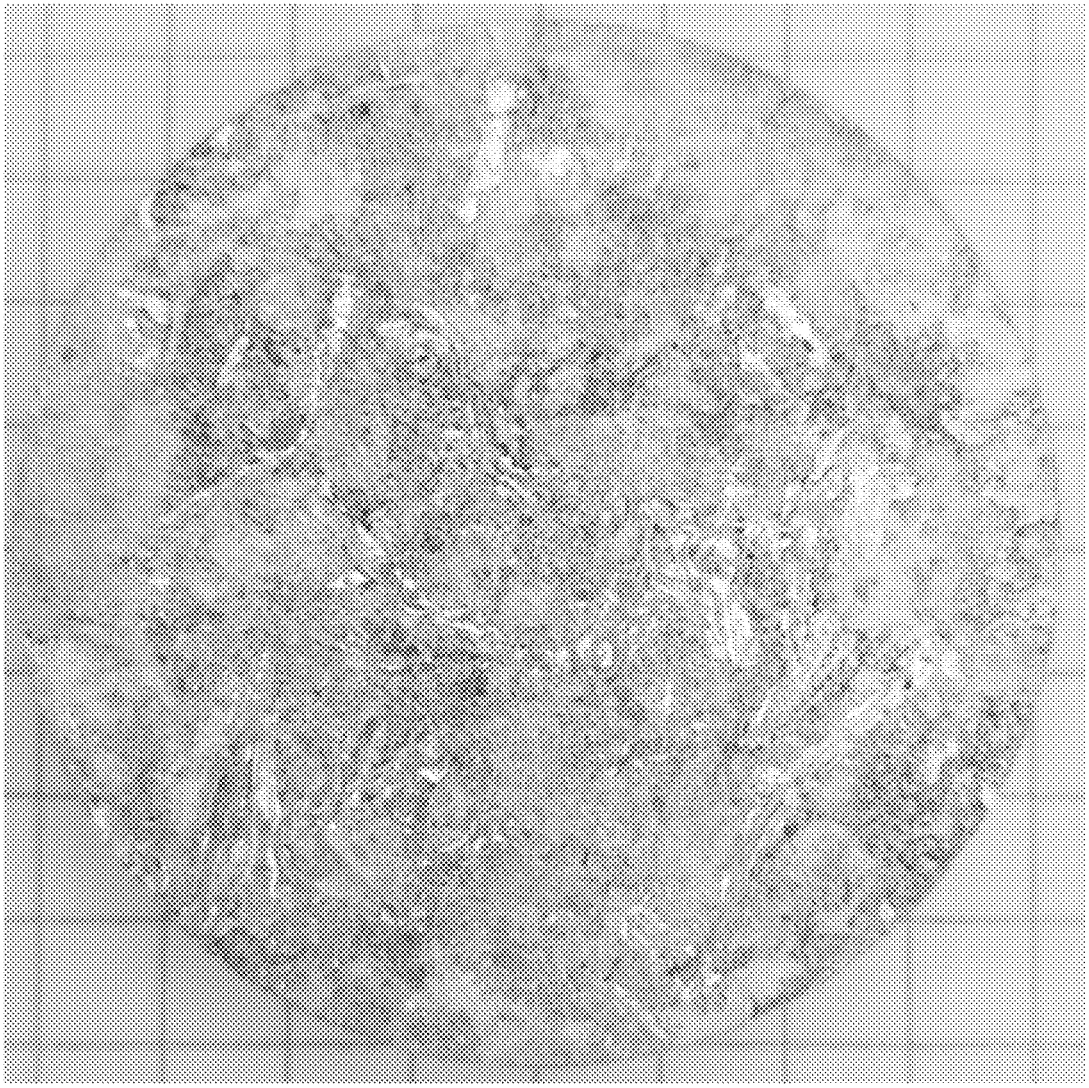
FIG. 7 shows a sample of a pressed silver dendrites with large dendrites.
Figure 8:
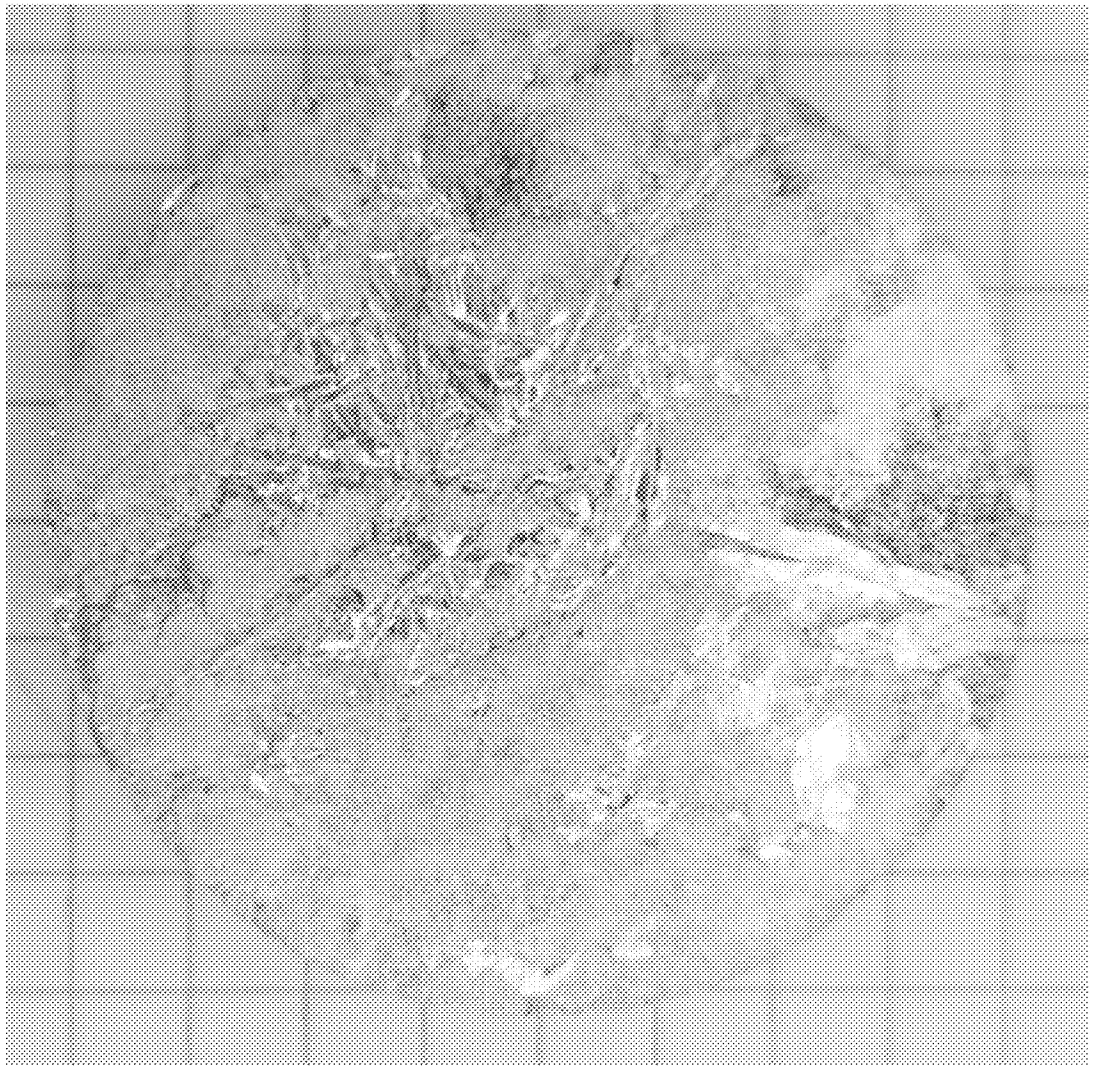
FIGS. 8 and 9 show another sample of a pressed silver dendrites with large dendrites.
Figure 9:
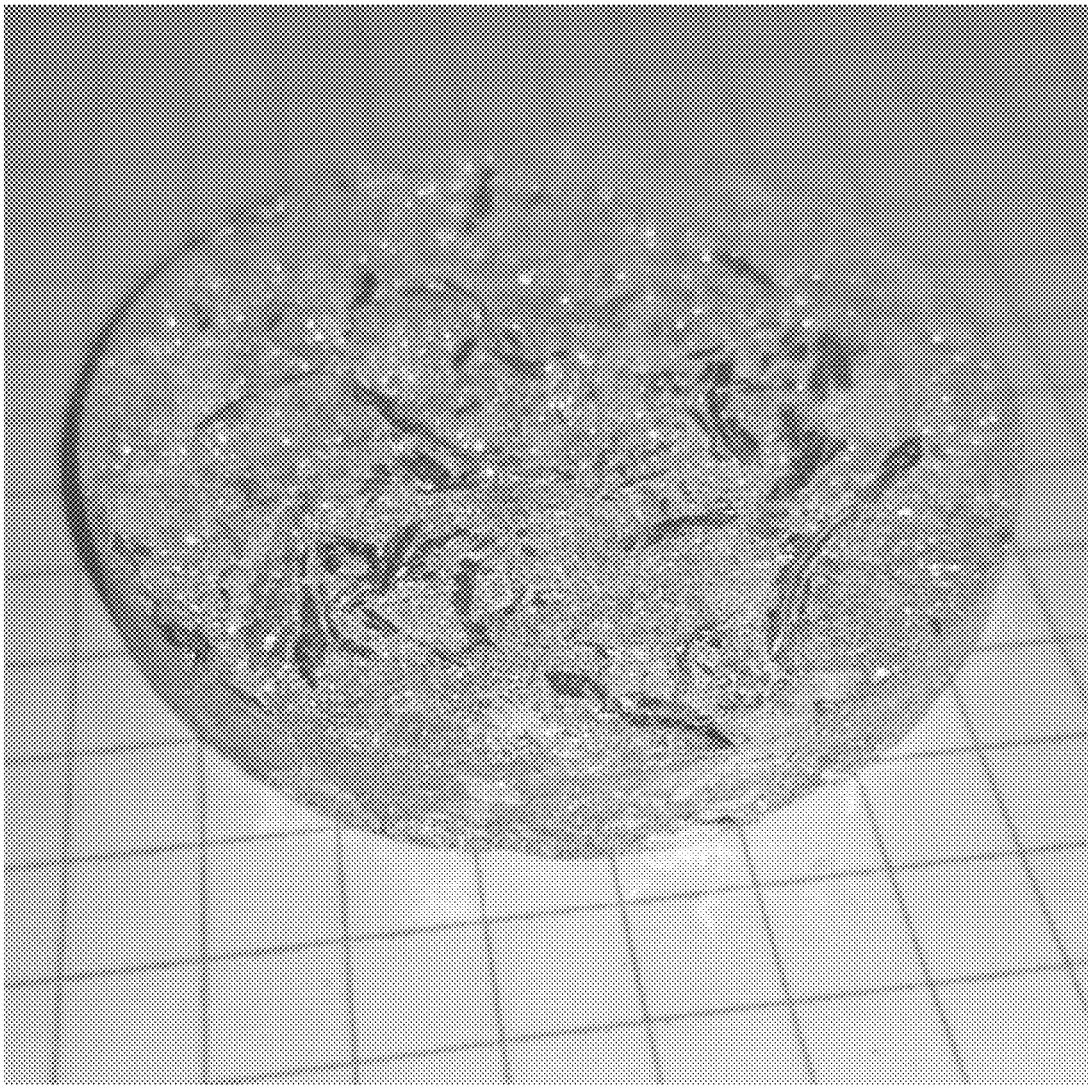
Figure 10:
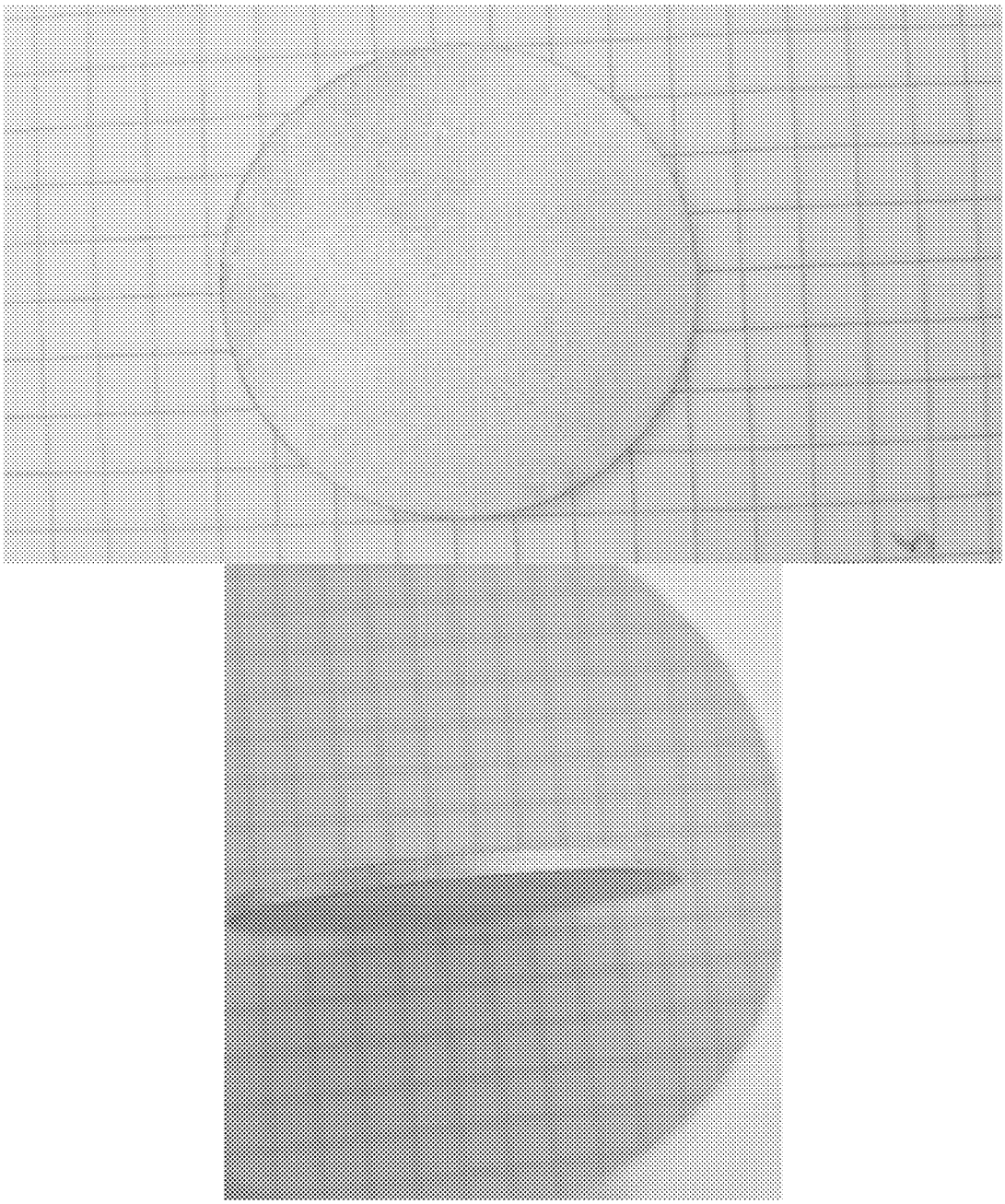
FIG. 10 shows a front and a side view of a sample of a pressed silver dendrites with finer dendrites.

More specifically, the silver metal article of manufacture of the invention is obtained by the following process:

(a) forming a saturated aqueous solution of silver, wherein the silver is a donor;

(b) subjecting the solution to electrolysis to form dendrite crystals of silver or silver nanowires, wherein both an anode and a cathode are made of silver;

(c) harvesting the dendrite crystals of silver or silver nanowires from the bottom of the solution;

(d) pressing the harvested dendrite crystals or silver nanowires into a geometric shape;

(e) sintering the geometric shape at about 300° F. followed by at about 600° F. for about 15 min to about 60 min;

(f) cooling the sintered geometric shape at room temperature, to room temperature; and (g) pressing or packing the cooled geometric shape to form the porous silver metal article of manufacture.

The process of the invention can be carried out with an aqueous solution of silver nitrate ($AgNO_3$). The process of the invention can be carried out with silver containing electrolytic solutions where silver acts like a donor during the electrolysis process.

A process for making a porous copper metal article of manufacture can be obtained following similar steps as in the process for obtaining the silver metal article of manufacture discussed above, except for the following steps:

In step (d), the step of pressing and packing the collected copper dendrite or nanowires are packed into carbon based molds or in vacuum to minimize oxidation.

In step (e), the step of heating the molded form is carried out in hydrogen gas or methane gas.

Step (g) above is not necessary as the copper metal has been packed in the mold in step (d). Instead, the copper article can be optionally treated with a silver plating solution to protect it from oxidation.

Accordingly, the method for making a porous copper metal article of manufacture comprises the steps of:

(a) forming a saturated aqueous solution of copper, wherein the copper is the donor, such as copper nitrate;

(b) subjecting the solution to electrolysis to form dendrite crystals of copper or copper nanowires, wherein both anode and cathode are made of copper;

(c) harvesting the dendrite crystals of copper or copper nanowires from the bottom of the solution.

(d) pressing and packing the collected dendrite crystals into a mold; wherein the mold is a carbon-based mold or wherein the mold is other than a carbon-based mold and the step is carried out in vacuum in order to minimize oxidization.

(e) heating the molded form at about 300° F. followed by at about 600° F. for about 15 min to about 60 min, in hydrogen gas or methane gas;

(f) cooling the sintered carbon-based mold at room temperature, to room temperature, to form the porous copper metal article of manufacture.

(g) optionally, the copper article can be treated with a silver plating solution to protect it from oxidation.

In a certain embodiment of the invention, the dendrite crystals of silver or copper form as strands extending outward from the cathode. In another embodiment, the silver or copper dendrite crystals fall off the cathode and sink to bottom of the solution. In a further embodiment, the silver or copper dendrite crystals are scraped off the cathode.

Different concentration (saturation) of silver nitrate or silver sulfate solution (or copper nitrate for copper) can provide different sizes of silver (or copper) dendrites or nanowires. Different currents can affect the shape of the silver or copper dendrites or the length of the silver nanowires. For example, more saturated solutions provide bulkier (square shape) dendrites and less saturated solutions provide spikier dendrites. A saturated solution can be about 5% and a dilute solution can be about <1%.

According to step b) of the invention, the electrolysis can carried out with a DC power source. The DC power source for example can be a 9V battery. In an embodiment using a 0V to 60V 5 A DC Power Supply, the voltage applied can be from the lowest to maximum voltage as the donor anode silver replenishes the solution of silver ions.

Alternatively, in step b) of the process according to the invention, electrolysis can be carried out with a pulse capacitor. Large-scale synthesis of silver or copper nanowires can be obtained. For example, the pulse capacitor can be a 400 W (300 V) pulse capacitor. When using a pulse capacitor, silver or copper nanowires can be obtained. The voltage of the pulse capacitor can be manipulated to influence the length of the silver or copper nanowires obtained.

Strands with length of at least 6 inches of silver or copper can be obtained with a 400 W pulse capacitor. The silver or copper nanowires could serve as seeds for the growth of silver or copper, respectively. These wires were also present in high yield (approximately 90%) and were produced in approximately one hour after commencement of electrolysis. One of the advantages of this particular synthesis is its simplicity and purity of the obtained metal.

After the dendrites or nanowires are harvested, they are pressed or packed into any geometric shape one desires. The geometric shape can be, for example, a disk, a cube, a pyramid, or any other geometric shape as needed.

When the geometric shape of the article of manufacture is a disk, it can have a measurement of about 3 cm in diameter and about 0.2 cm in thickness.

However, the dimensions of the article of manufacture is not limited to the measurements mentioned above as one skilled in the art would readily appreciate that different size diameters and thickness can be obtained based upon the desired final article of manufacture.

In the process according to the invention, the dendrite crystals of silver can grow at a rate of about 10 g/hr. Similarly, in the process according to the invention, the dendrite crystals of copper can grow at a rate of about 10 g/hr. For example, a 1 oz dollar or quarter size coin can be obtained within approximately 24 hours.

The silver metal article of manufacture of the invention is porous and the flow rate of the porous silver metal article of manufacture can be measured by pouring tap water onto it. The flow rate of a 1 oz dollar or quarter size coin having 3 cm in diameter and about 0.2 cm in thickness is about 2 ml/sec under atmospheric temperature and atmospheric pressure. The initial, pre-water pouring weight of the article is about 0.18 oz, while the weight of the article after pouring water is about 0.19 oz. This demonstrates that the silver metal article of manufacture obtained by the invention is porous because it can retain water within its pores.

The following example provides further appreciation of the invention discussed herein. The silver metal article of manufacture was obtained according to the method of the invention. The silver dendritic crystals were collected and pressed in a mold of 50 mm in diameter at varying PSI (pounds per square inch) pressure, in intervals of 1000 psi. Each sample weighed within 31.3 g-31.5 g.

Figure 11:
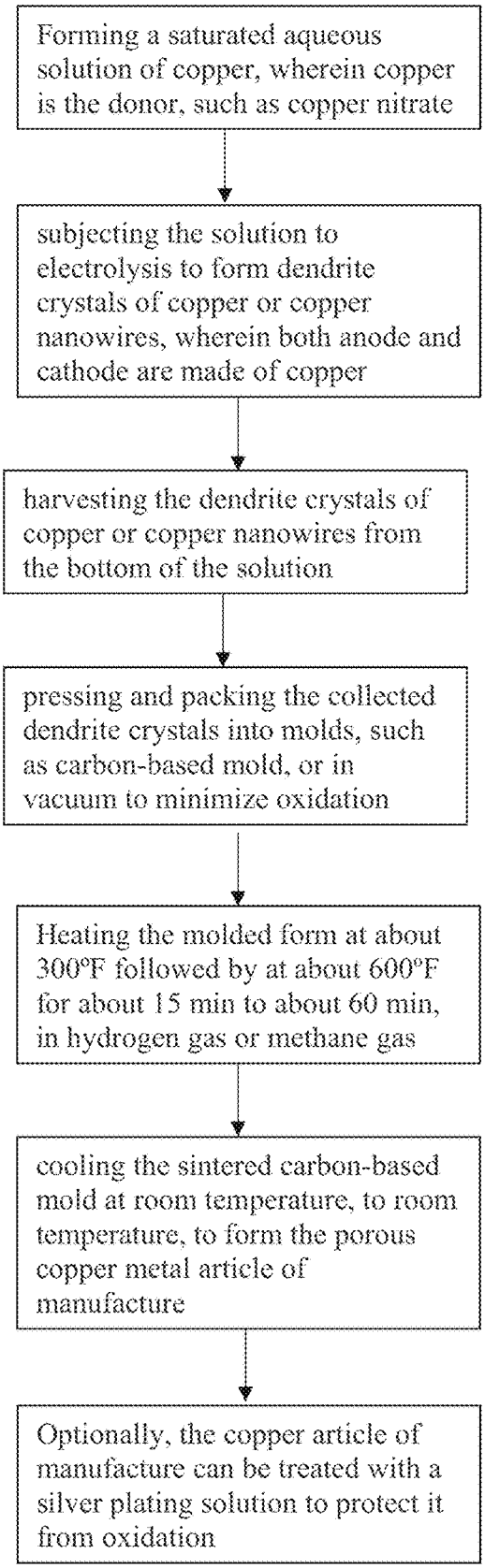
FIG. 11 is a flow chart of a process according to the invention where porous copper is obtained.

The thickness of the resultant disk pressed at a given PSI (horizontal and vertical angle) was measured to determine the average thickness of each disk. See Tables 1 and 2 and FIG. 11

TABLE 1

Thickness measurement of disk pressed at given PSI

| PSI | Thick-H mm | Thick-V mm | Avg Thick mm | Weight-Dry g | Weight-Wet g | Water Weight g |
|---|---|---|---|---|---|---|
| 1000 | 2.97 | 2.96 | 2.965 | 31.3 | 33.2 | 1.9 |
| 2000 | 2.68 | 2.66 | 2.67 | 31.5 | 33 | 1.5 |
| 3000 | 2.45 | 2.45 | 2.45 | 31.3 | 32.6 | 1.3 |
| 4000 | 2.26 | 2.33 | 2.295 | 31.5 | 32.6 | 1.1 |
| 5000 | 2.23 | 2.09 | 2.16 | 31.4 | 32.5 | 1.1 |
| 6000 | 2.28 | 2.18 | 2.23 | 31.5 | 32.3 | 0.8 |
| 7000 | 2.09 | 2.11 | 2.1 | 31.4 | 32.3 | 0.9 |
| 8000 | 2.06 | 2.18 | 2.12 | 31.3 | 32.1 | 0.8 |
| 9000 | 2.08 | 2.14 | 2.11 | 31.5 | 32.3 | 0.8 |

TABLE 2

| PSI | Thickness mm |
|---|---|
| 1000 | 2.97 |
| 2000 | 2.67 |
| 3000 | 2.45 |
| 4000 | 2.30 |
| 5000 | 2.16 |
| 6000 | 2.23 |
| 7000 | 2.10 |
| 8000 | 2.12 |
| 9000 | 2.11 |

Figure 12:
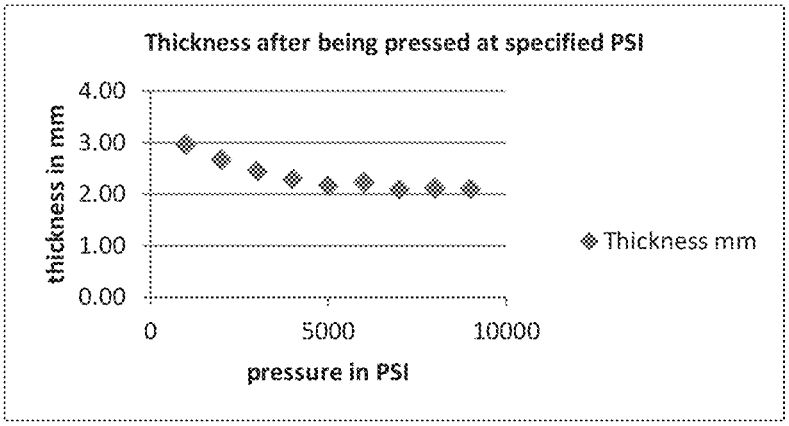
FIG. 12 is a graph showing the thickness of a pressed silver article at specified PSI.
Figure 13:
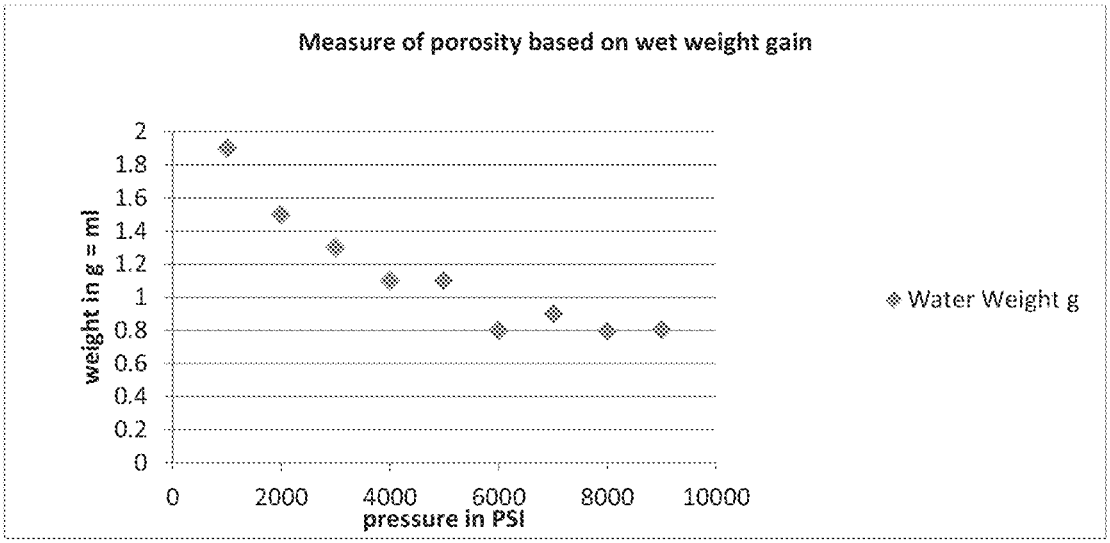
FIG. 13 is a graph showing the measurement of porosity of the silver article measured

The difference between the dry weight and wet weight of the disks were measured to determine the porosity given the weight of the water retained (water: gram=ml), per known PSI. See Table 3 and FIG. 12.

TABLE 3

| PSI | Water Weight g |
|---|---|
| 1000 | 1.9 |
| 2000 | 1.5 |
| 3000 | 1.3 |
| 4000 | 1.1 |
| 5000 | 1.1 |
| 6000 | 0.8 |
| 7000 | 0.9 |
| 8000 | 0.8 |
| 9000 | 0.8 |

The dendritic form of the collected silver is irregular in size which could cause inconsistent press results on higher PSI due to the distribution of the aggregate material. However, compression leveled off after 7,000 psi on the 50 mm diameter mold. The silver nanowires are much thinner than the dendrites and less irregular in size than the dendrites. The silver nanowires would provide a different set of results when measuring the thickness after being pressed and the porosity. Thus, one skilled in the art can decide which form of silver to use to arrive at the desired silver article of manufacture.

Similarly, porous copper metal article of manufacture can also be obtained using similar steps as in the above example. The copper metal is obtained by forming a saturated aqueous solution of copper nitrate; subjecting the solution to electrolysis to form dendrite crystals of copper or copper nanowires, wherein both the anode and the cathodes are made of copper; harvesting the dendrite crystals of copper or copper nanowires from the bottom of the solution.

The harvested copper dendrites or nanowires are pressed and packed into molds, such as carbon-based mold or in vacuum in order to minimize oxidation. The molded form is heated at about 300° F. followed by at about 600° F. for about 15 minutes to about 60 minutes, in hydrogen gas or methane gas. The sintered carbon-based mold is cooled at room temperature, to room temperature, to form the porous copper metal article of manufacture.

At the end of the process, the copper article of manufacture can be treated with a silver plating solution in order to protect it from oxidation.

In another embodiment, the copper crystals collected were silver plated by adding silver nitrate to the copper nitrate solution, then pressed and heat treated.

It has been found that this lighter metal can create a foam like structure which can be controlled by modifying the current and amp applied during the electrolysis process. It has also been found that heat treatment causes oxidation, which can be minimized by packing the copper metal in a carbon mold during the heat treatment. Further, oxidation can be removed by heating the pressed copper in hydrogen or methane gas. The pressed copper metal can also be silver plated by soaking in silver nitrate.

With the invention the pore sizes of the silver metal article of manufacture or the copper metal article of manufacture can be controlled more effectively. For example, the pore size can be controlled by the type of silver product harvested from the bottom of the solution, which can be dendrites or nanowires. The pore size of the article obtained by the invention is further controlled during the pressing or packing step. For example, a 4 lb mallet can be used to press or pound onto the article to about 0.2 cm in thickness. Different thicknesses can be obtained using the 4 lb mallet.

The method according to the invention provides a silver metal article of manufacture and a copper article of manufacture that can be made efficiently. As a result, the characteristics of the silver metal article of manufacture and the copper article of manufacture resulting from the method according to the invention can be realized more accurately. This enables a production of silver metal article of manufacture and the copper article of manufacture based upon a specification of the desired characteristics of the article, like pore sizes.

The silver metal article of manufacture and the copper article of manufacture produced according to the present invention provides a number of advantages, such as, pure metal that is porous and workable that can be packed into a porous material that is easy to shape in any form. The silver cathode can also provide the advantage of being used as a seed crystal for the silver metal article of manufacture, while the copper cathode provide the advantage of being used as a seed crystal The silver metal article of manufacture and the copper article of manufacture produced according to the present invention can be used, for example, as membranes which can be particularly useful for filtration of water, separation of organic solutions, clarifying wines and juices.

While various embodiments of the present invention have been described in some detail, it is apparent that modifications and adaptations of those embodiments will occur to those skilled in the art. However, it is to be expressly understood that such modifications and adaptations are within the spirit and scope of the present invention.

The invention claimed is:

1. A method for making a porous copper metal article of manufacture comprising:

(a) forming a saturated aqueous solution of copper, wherein the copper is the donor;

(b) subjecting the solution to electrolysis to form dendrite crystals of copper or copper nanowires, wherein both anode and cathode are made of copper;

(c) harvesting the dendrite crystals of copper or copper nanowires from the bottom of the solution;

(d) pressing and packing the collected dendrite crystals into a mold;

(e) heating the molded form at about 300° F. followed by at about 600° F. for about 15 min to about 60 min, in hydrogen gas or methane gas and obtain a sintered carbon-based mold;

(f) cooling the sintered carbon-based mold at room temperature, to room temperature, to form the porous copper metal article of manufacture; and (g) optionally, treating the porous copper metal article of manufacture with a silver plating solution to protect it from oxidation, wherein in step b) the electrolysis is carried out with a DC power source, and wherein the DC power source is an adjustable 60V 5A DC power supply.

2. The method according to claim 1, wherein the copper solution is copper nitrate.

3. The method of claim 1, wherein the dendrite crystals of copper form as strands extending outward from the cathode.

4. The method of claim 1, wherein in step b) the copper dendrite crystals fall off the cathode and sink to bottom of the solution, or alternatively, the copper dendrite crystals are scraped off the cathode.

5. The method of claim 1, wherein in step d) the mold is a carbon based mold, or alternatively, the mold is not a carbon based mold and the step is carried out in vacuum.

6. The method of claim 1, wherein the DC power source is a 9V battery.

7. The method of claim 1, wherein in step b) the electrolysis is carried out with a pulse capacitor.

8. The method of claim 7, wherein the pulse capacitor is a 400 W pulse capacitor.

9. The method of claim 1, wherein the porous copper metal article of manufacture has a geometric shape in the form of a disk.

10. The method of claim 9, wherein the disk has a measurement of about 3 cm in diameter and about 0.2 cm in thickness.

11. The method of claim 1, wherein the dendrite crystals of copper grow at a rate of about 10 g/hr.

12. The method of claim 1, wherein a flow rate of the porous copper metal article of manufacture is about 2 ml/sec using tap water under atmospheric temperature and atmospheric pressure.

* * * * *